United States Patent [19]

Wallsten

[11] 4,259,921

[45] Apr. 7, 1981

[54] SELECTIVELY CONVERTIBLE APPARATUS FOR TREATING A MOVING WEB

[75] Inventor: Hans I. Wallsten, Lausanne, Switzerland

[73] Assignee: Inventing S.A., Lausanne, Switzerland

[21] Appl. No.: 56,503

[22] Filed: Jul. 11, 1979

[30] Foreign Application Priority Data

Dec. 20, 1978 [SE] Sweden ..... 7813128

[51] Int. Cl.[3] ..... B05C 1/08; B05C 3/172

[52] U.S. Cl. ..... 118/206; 118/262; 118/405; 118/413; 118/414

[58] Field of Search ..... 118/262, 405, 407, 414, 118/206, 413, 412, 419, 235

[56] References Cited

U.S. PATENT DOCUMENTS

| | | | |
|---|---|---|---|
| 1,989,036 | 1/1935 | Bradner | 118/206 |
| 2,534,320 | 12/1950 | Taylor | 118/407 X |
| 3,044,440 | 7/1962 | Molsberry et al. | 118/262 X |
| 3,152,008 | 10/1964 | Skinner | 118/413 X |
| 3,231,418 | 1/1966 | Muggleton | 118/407 X |
| 3,899,615 | 8/1975 | Wallsten | 427/211 |

*Primary Examiner*—John P. McIntosh

[57] ABSTRACT

Apparatus selectively convertible to perform one or more coating operations on a web of paper or the like comprises a fixed rotatable roller, a coating blade movable into and out of coating relation with the surface of the fixed roller and cooperating with a dam of coating material to coat a web as it passes through the nip between the coating blade and the fixed roller, and a second movable roller movable into and out of nip forming relation with the fixed roller with provision for adjustment of pressure in the nip and adapted to cooperate with a dam of coating material to coat a web as it passes through the nip between said rollers, said movable roller also being adapted alternatively to receive coating material and to transfer it to the fixed roller to coat one side of a web as it runs over the latter.

7 Claims, 3 Drawing Figures

SELECTIVELY CONVERTIBLE APPARATUS FOR TREATING A MOVING WEB

BACKGROUND OF THE INVENTION

The present invention relates to apparatus for coating a moving web of paper or the like, and more particularly to new and improved coating apparatus that is capable of conversion selectively in a simple and highly effective manner to enable it to perform one or more different treatment operations on a moving web.

It is well known that the two sides of a paper web can be effectively coated by causing the web to run downwardly through a dam containing coating material and disposed immediately upstream of the nip between a thin, flexible coating blade and a support roller rotating in the direction of movement of the web, as disclosed in U.S. Pat. No. 3,489,592. In order to prevent so-called "orange peel" patterning, the coated web, upon leaving the nip is caused to be deflected at a suitable angle to the tangent to the support roller through the point of contact. Also, double sided web coating with different coating compositions can be performed by applying a second coating material to the surface of the support roller, as taught in U.S. Pat. No. 3,899,615.

Such apparatus can also be used for surface sizing of a web by supplying a starch solution to the dam through which the web passes. Since the pressure zone is extremely short in the direction of movement of the web because of the thinness of the coating blade (e.g. 0.3 mm), the impregnation of the web is not deep.

This is often a great advantage if the only aim is high surface strength and effective binding of the fibers on the surface of the paper. Since the binder is confined to the surface of the paper, less binder is required for a specific surface strength. Also, a higher concentration of treating solution can be used, leaving relatively little water to dry off, so that less energy is required for drying the web subsequently.

It is also old to improve the surface strength of a paper web surface sizing in a tub sizing machine comprising two rotating rollers forced together under pressure, at least one of the rollers usually being covered with rubber. In practice, the rollers may be disposed horizontally or diagonally in relation to each other and the paper web passes through a nip between them and through coating material contained in a dam formed by the two sides of the web and the adjacent roller surfaces immediately above the nip.

In surface sizing in a tub sizing machine, a relatively long pressure zone is produced in the direction of movement of the web. Accordingly, the treating liquid, starch solution for example, is first pressed inwardly towards the center of the web and is thereafter absorbed to a certain extent as the web gradually passes through the zone.

Good impregnation of the binder is essential if satisfactory inner strength is to be achieved with certain qualities of paper and cardboard. This may be of importance in the manufacture of cardboard, for example, which is to be folded and thus subjected to stress in the center of the sheet. Insufficient internal binding may result in the paper splitting. Good impregnation is also desired in the manufacture of paper and cardboard which is to be very stiff, this being achieved by causing the treating starch to penetrate to the center of the paper.

Heretofore, a manufacturer desiring to produce both products having high surface strength and products such as cardboard requiring good impregnation of a binder for satisfactory inner strength was required to have in his plant separate machines of the kinds described above. While such machines are effective in their respective fields, this practice is wasteful of space, expensive, and it may be inefficient if not all of the machines can be utilized simultaneously.

SUMMARY OF THE INVENTION

It is an object of the invention, accordingly, to provide new and improved apparatus for treating a web of paper or the like that can readily be converted selectively to perform one or more different web treating operations on a moving web.

Another object of the invention is to provide new and improved apparatus of the above character for treating a web of paper or the like that is moderate in cost and efficient in its use of space.

Web coating apparatus according to the invention comprises a first support roller mounted for rotation selectively in opposite directions on a frame to provide lateral support for a web of paper or the like as it runs along a downward path. Mounted on the frame for movement towards and away from the first support roller is a blade holder carrying a coating blade that can be releasably retained with its edge pressing the web against the support roller. Means cooperates with the blade to form a dam for coating material between one side of the web and the blade and between the other side of the web and the adjacent surface of the support roller.

Also mounted on the machine frame is a second rotatable support roller having means for moving it into and out of engagement with the first support roller and for adjusting the pressure in the nip between the two rollers. The web and the adjacent surface portions of the two rollers are adapted to cooperate with means forming a dam for supplying coating material to the opposite sides of the web.

Single sided coating of the web is accomplished by running the web through the nip between the coating blade and the first support roller, with coating material in a dam on one side of the web. For double coating the web with the same coating material on both sides, the web is run through the nip between the coating blade and the support roller with coating material in a dam common to the two web sides.

Where different coating materials are to be applied to the opposite sides of the web, the web is wrapped around a segment of the support roller as it runs through the nip between the latter and the coating blade so that coating material is applied only to the outside of the web. A different coating material is applied to the other side of the web by engaging the surfaces of the first and second support rollers and using the latter as an applicator roll for applying coating material from another source to the surface of the first support roller around part of which the web runs.

Where relatively deep impregnation of the web with coating material is desired, the web is run through the nip between the first and second support rollers with coating material in a dam on one or both sides of the web, sufficient pressure being used to effect the degree of impregnation desired. To this end, the direction of rotation of the first support roller is reversed so that the roller surfaces both move in the direction of travel of the web. In this case, the blade and blade holder are not used and are swung away from the first support roller and releasably retained in the desengaged position.

DESCRIPTION OF PREFERRED EMBODIMENTS

For a better understanding of the invention, reference is made to the following description of several representative embodiments, taken in conjunction with the accompanying drawings, in which.

Figure 1:
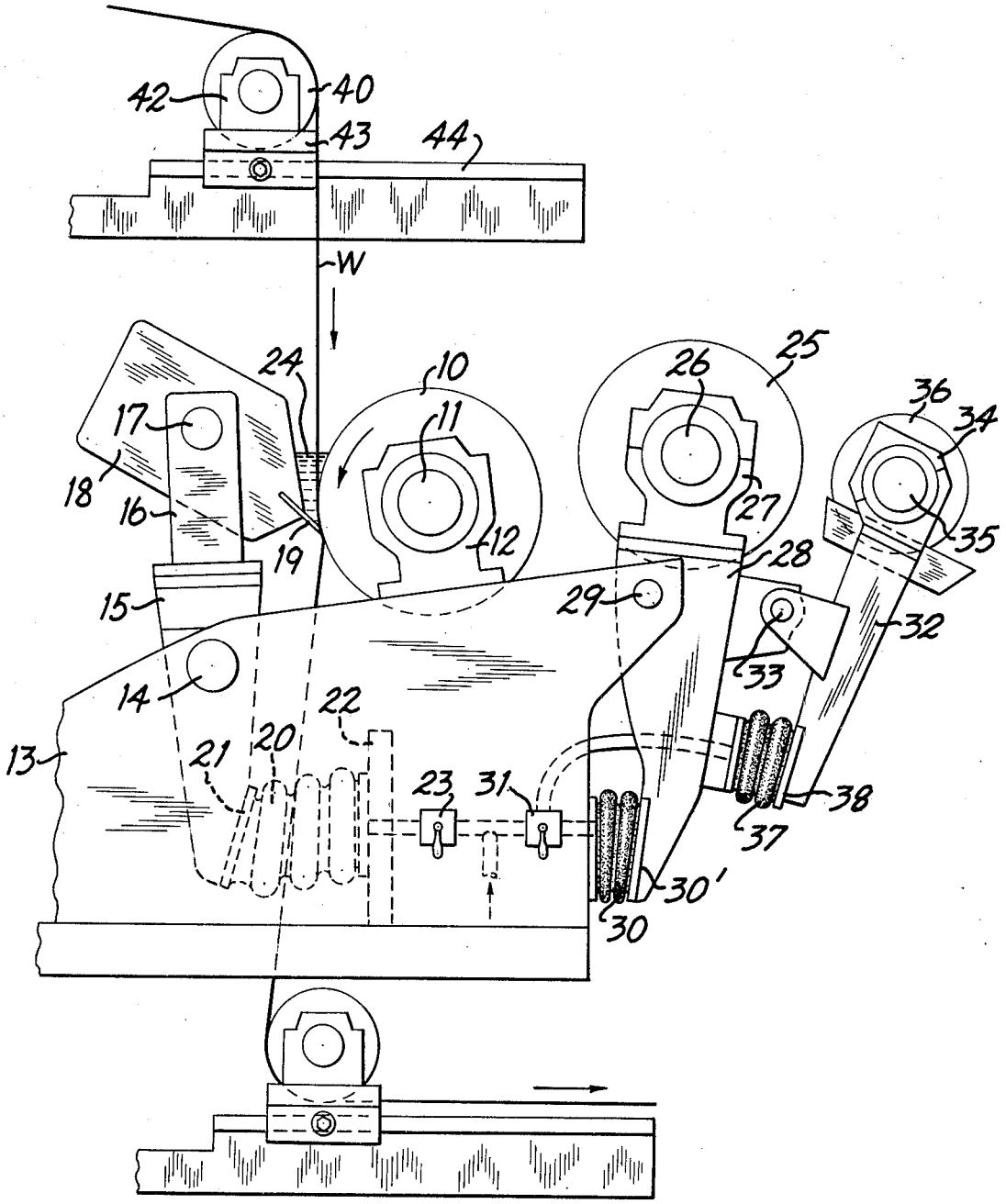
FIG. 1 is a schematic side view of web coating apparatus constructed according to the invention set to coat both sides of a paper web.

Referring first to FIG. 1, web coating apparatus according to the invention comprises a web support roller 10, preferably coated with rubber and having a shaft 11 rotatably mounted in bearings 12 secured to the machine frame 13. The shaft 11 is adapted to be driven selectively in opposite directions by conventional reversible motive means (not shown). Mounted on pivots 14 journalled in the machine frame 13 on opposite sides thereof are a pair of arms 15 (only one being visible in FIG. 1) having at their upper end supports 16 in which are journalled pivots 17 carrying a blade holder 18 in which is mounted a conventional coating blade 19. Preferably, the mass of the blade holder 18 is so distributed that the normal rest position of the holder is substantially shown in FIG. 1 with the blade 19 extending towards the roller 10.

The blade holder 18 is adapted to be moved towards and away from the roller 10 to bring the blade 19 into and out of operation therewith and to set the pressure in the nip therebetween. To this end, suitable means such as expansible bellows 20 are interposed between an actuator member 21 at the lower end of each arm 15 and stop members 22 secured to the machine base. The bellows may be actuated by a fluid such as compressed air supplied thereto through a conventional controller 23. Actuation of the controller 23 to move the blade 19 into coating position adjacent the support roller 10 also brings the latter in cooperating relationship with means (not shown) forming a dam 24 for coating one or both sides of the web in the well-known manner. The dam 24 is adapted to be supplied with coating material in the conventional manner.

Also mounted on the machine frame 13 for movement towards and away from the support roller 10 and with its axis of rotation parallel thereto is a second rotatable support roller 25 of about the same diameter as the roller 10. The roller 25 is mounted on a shaft 26 journalled in bearings 27 carried at the upper ends of the lever arms 28, only one of which is visible in FIG. 1, and it is adapted to be driven selectively in either direction of rotation. To this end, it may be provided with its own controllable motive means (not shown), or it may be driven by the same motive means as the roller 10 through a suitable reversing controller (not shown).

The arms 28 are mounted on pivots 29 journalled in the frame 13 and are adapted to be actuated by means such as the expansion bellows 30 interposed between the machine frame and actuator members 30' at the lower ends of the arms 28. The bellows may be actuated by a fluid such as compressed air supplied thereto through a conventional controller 31. By adjustment of the controller 31, the arms 28 can be actuated to move the roller 25 into and out of nip forming relation with the roller 10 and to adjust the pressure in the nip as required.

A pair of third lever arms 32 are mounted on pivots 33 journalled on the lever arms 28 and have bearings 34 at their upper ends, in which are journalled the ends of a shaft 35 supporting a third roller 36. The roller 36 is adapted to be moved into and out of nip forming relation with the roller 25 by means such as expansion bellows 37 interposed between the machine frame and actuator members 38 at the lower ends of the arms 32. The bellows 37 may be expanded and contracted by a fluid such as compressed air supplied thereto from the controller 31 when the latter is in a selected control setting.

When it is desired to coat a web using the coating blade-support roller technique of U.S. Pat. No. 3,489,592, the controllers 23 and 31 are set so that the blade holder 18 and blade 19 are moved to the coating position in relation to the roller 10, with the second support roller 25 positioned away from the support roller 10, as shown in FIG. 1. The web W runs downwardly over a guide roller 40 in a substantially vertical path through the nip between the blade 19 and the support roller 10 with coating material supplied to the dam 24. Suitable means such as a web deflecting roller (not shown) may be provided for drawing the web over the edge of the blade at an angle inclined outwardly in relation to the tangent through the point of contact between the blade and the support roller, as disclosed in prior U.S. Pat. No. 3,489,592. In this fashion, one or both sides of the web may be coated with the same coating medium.

Figure 2:
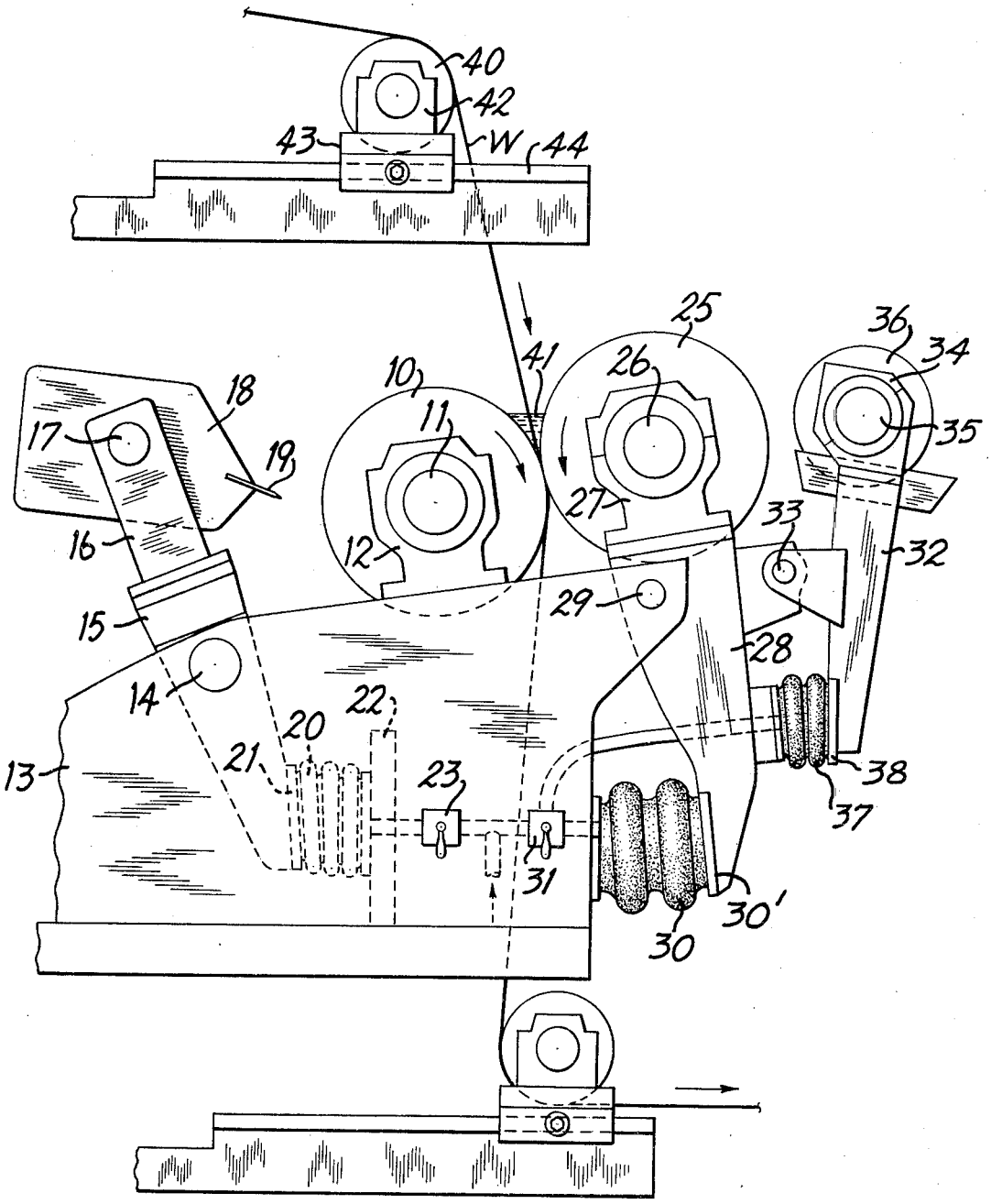
FIG. 2 is a schematic side view of the apparatus of FIG. 1 arranged as a tub sizing press.

The apparatus of FIG. 1 may be converted to a tub sizing press by actuating the controller 23 to move the blade holder 18 and the blade 19 away from the support roller 10 to the position shown in FIG. 2; actuating the controller 31 to position the support roller 25 adjacent the support roller 10 so as to form a nip therebetween with the third roller 35 out of engagement with the roller 29; providing a dam 41 just above the nip between the rollers 10 and 25 for coating one or both sides of a web in the conventional manner as it runs through the nip; and positioning the guide roller 40 so that the web W runs through the nip between the rollers 10 and 25 with size in the dam 41, and with the drive means for the rollers 10 and 25 set to rotate them in opposite directions, as shown in FIG. 2.

If the support rollers 10 and 25 are covered with suitable material, the conversion of the equipment from coating and surface sizing to impregnation, and vice versa, can be formed merely by altering the path of the paper web and reversing the direction of rotation of the support roller 10. To facilitate the former, the guide roller 40 is rotatably mounted in bearings 42 carried by a member 43 slidable on rails 44 and releasably lockable at different locations therealong. The line pressure required in the nip 41 is, of course, different for the two kinds of operations, and it must be set to an appropriate value in each case by adjustment of the controller 31.

Figure 3:
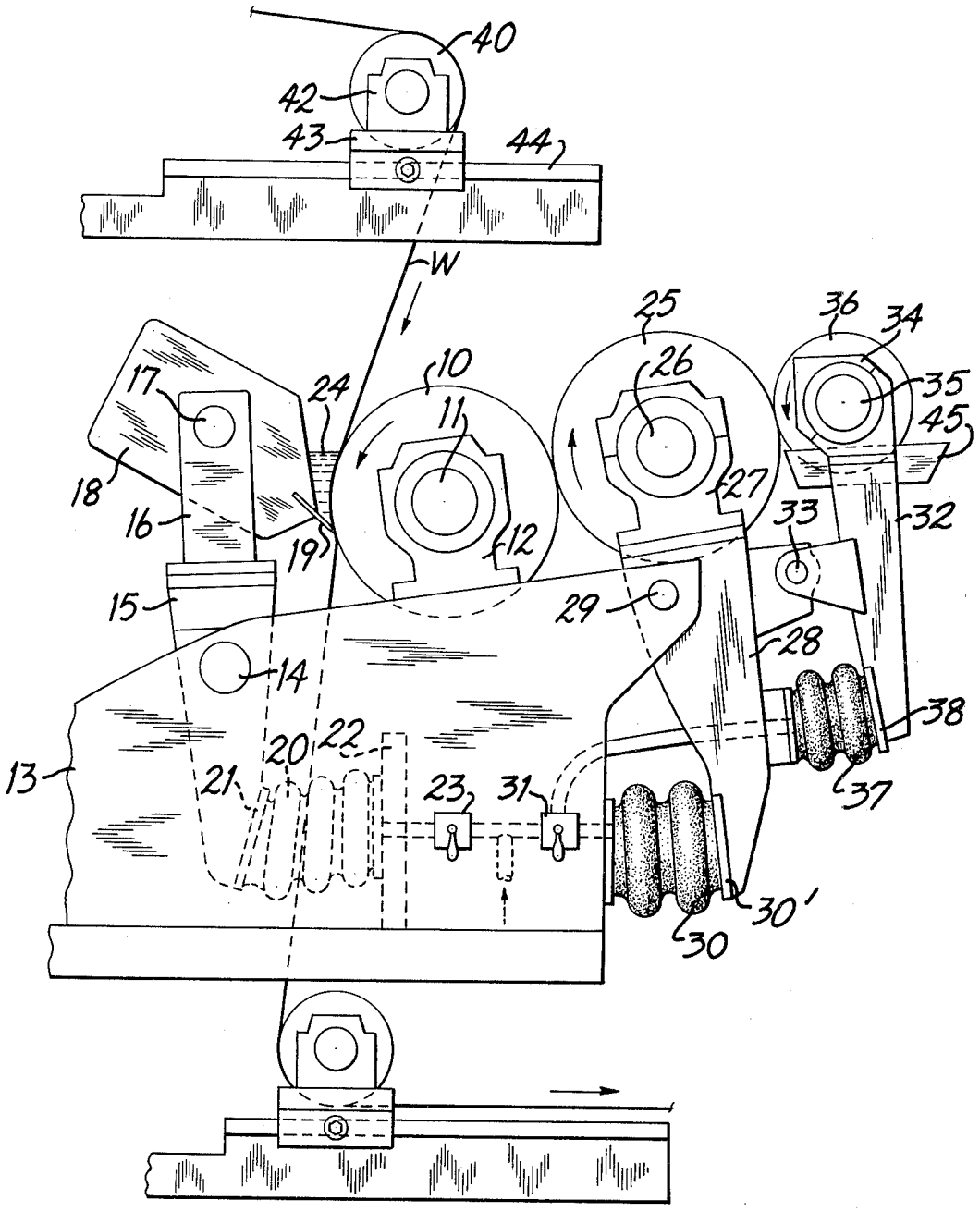
FIG. 3 is a schematic side view illustrating the apparatus of the invention set to coat the opposite sides of the web with different coating materials.

The apparatus in FIGS. 1 and 2 is extremely simple, as well as being compact and inexpensive. By a simple conversion as described, it can be used either for single or double sided coating by the coating blade-support roller technique, or as a tub sizing press for surface sizing and impregnation of the web. This is extremely advantageous, particularly in a paper mill where space requirements are often cirtical.

Where it is desired to coat the opposite sides of a web with different coating materials, the controllers 23 and 31 are set to position the blade holder 18 and the rollers 10, 25 and 36 as shown in FIG. 3. Also, the guide roller 40 should be moved to the position shown such that the downwardly running web W is wrapped around a peripheral segment of the support roller 10. As in FIGS. 1 and 2, one side of the web W may be coated by the coating blade 19 with coating material in the dam 24.

The other side of the web W is adapted to be coated by applying coating material to the surface of the roller 10. To this end, the second support roller 25 may serve as a coating applicator with either its lower surface or the lower surface of the third roller 36 engaged therewith immersed in a container 45 of coating material. By suitable adjustment of the speed drive means (not shown) for the rollers 25 and 36, the latter may be rotated at speeds appropriate for coating the roller 10 effectively. Also, by adjustment of the controller 31, the pressure can be set to a value suitable for effective coating of the roller 10 which applies the coating material to the adjacent side of the web W. In this manner, either like or different coating materials may be effectively applied to the two sides of the web.

As stated, rubber covered rollers are preferable, although not always necessary. In a practical machine, the roller 10 in FIG. 1 may have a rubber covering with a hardness of about 20–30 P&J, and the roller 25 a surface hardness from 0 to 20 P&J. In certain cases, the roller 25 may be made of steel. Preferably, the roller 10 should be of rubber with a hardness between 20 and 100 P&J.

The diameter of the roller 10 may suitably be between 400 and 1200 mm, depending on the machine width and speed. As previously mentioned, the diameter of the roller 25 should not differ greatly from the diameter of the roller 10. Preferably, the distribution roller 36 should be smaller than the other two rollers. Also, the roller 36 may be omitted and the roller 25 used as a distributing roller with its lower surface immersed in a container of coating material.

Apparatus according to the invention has been used effectively in the treatment of both sized and unsized wood-containing and wood-free printing paper by surface sizing with starch on one or both sides and by coating with clay dispersion on one or both sides. Also, paper for printing purposes has been impregnated to achieve good internal binding of the fibers. The invention has also been used in the treatment of paper for commercial purposes such as paper used in the manufacture of carbon-free paper for carbonless papers. Cardboard for folding and for the production of fluting cardboard, which must be extremely stiff, has also been impregnated.

The invention thus provides simple yet highly effective apparatus that can readily be converted selectively for treatment of a paper web in a variety of ways. The apparatus is compact and comprises only a few parts so that it is reasonable in cost and economical in its use of space. By virtue of its simplicity, no special operating personnel are required and machine down time is minimized, so that vast savings can be effected.

The details of the dams for the coating agents have not been shown since they are all old and well-known per se. In the customary practice, coating agent is supplied through piping and is allowed to fall freely down into a nip between rollers or between a coating blade and a roller. Usually, an excess of coating agent is supplied and the excess flows out at the ends of the rollers in a roller nip for collection and return to the coating agent supply.

The several embodiments disclosed are only illustrative and modifications in form and detail are possible within the compass of the invention. For example, the roller 25 need not always be separately driven but can be driven off the roller 10 when it is in frictional contact with the latter. Also, the necessary movements of the coating blade and rollers may be effected by other means such as cams or compressed air cylinders, in place of the expansion bellows shown. Moreover, the roller 10 may be driven selectively in the forward or reverse direction by any suitable means such as a reversible electric motor or a reversing gear box. The invention is intended to encompass all such modifications within the scope of the following claims.

I claim:

1. Apparatus selectively convertible to perform one or more coating operations on a web of paper or the like comprising, a first rotatable support roller, a coating blade movable between a first fixed position in web coating relation to the surface of said support roller and a second fixed position away from said roller, controllable means for setting said coating blade selectively at either of said first and second fixed positions, means adapted to cooperate with said blade in said first fixed position and with said support roller to form a dam for coating material to be applied to a web passing through the nip between said coating blade and said support roller, a second rotatable support roller disposed with its axis of rotation parallel to said first support roller and mounted for movement from an active position in which it forms a nip with said first roller to an inactive position away from said first roller, controllable means for setting said second support roller selectively at either of said active or inactive positions, means adapted to cooperate with said rollers in said active position to form a dam for coating material, and drive means for said first and second support rollers.

2. Web coating apparatus as defined in claim 1 in which the drive means is selectively controllable to rotate said first support roller in one direction for coating a web passing through the nip between said first support roller and said coating blade, or to rotate said first and second support rollers in the direction of travel of a web passing through the nip therebetween.

3. Web coating apparatus as defined in claim 2 together with a third coating distributing roller adapted to be positioned selectively in engaged or disengaged relation to the surface of said second support roller, controllable means for setting said third roller selectively in either of said engaged or disengaged positions, and means for applying coating material to said third roller.

4. Web coating apparatus as defined in claim 3 together with guide means selectively adjustable to cause a moving web to run in a downward path either between said coating blade and said first support roller or between said first and second support rollers.

5. Web coating apparatus as defined in claim 1 or claim 4 in which the surface of said first support roller comprises a soft rubber sheath.

6. Web coating apparatus as defined in claim 5 in which said rubber sheath has a hardness between 20 and 100 P&J.

7. Web coating apparatus as defined in claim 6 in which the diameter of the second support roller is substantially the same as the diameter of the first support roller.

* * * * *